US007084891B2

(12) United States Patent
Ueda

(10) Patent No.: US 7,084,891 B2
(45) Date of Patent: Aug. 1, 2006

(54) PHOTOPRINTER PRINTING IMAGE ON RECORDING PAPER

(75) Inventor: Hideo Ueda, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 163 days.

(21) Appl. No.: 10/919,595

(22) Filed: Aug. 17, 2004

(65) Prior Publication Data

US 2005/0041087 A1 Feb. 24, 2005

(30) Foreign Application Priority Data

Aug. 19, 2003 (JP) ..... 2003-295426

(51) Int. Cl.
*B41J 2/32* (2006.01)

(52) U.S. Cl. ..... 347/175

(58) Field of Classification Search ..... 347/172, 347/174, 175; 400/120.03
See application file for complete search history.

(56) References Cited

U.S. PATENT DOCUMENTS 5,743,663 A * 4/1998 Imai ..... 400/120.04

FOREIGN PATENT DOCUMENTS

JP 2002-67363 3/2002

OTHER PUBLICATIONS

Patent Abstracts of Japan, Publication No. 2002-067363 dated Mar. 5, 2002, 1 pg.

* cited by examiner

*Primary Examiner*—Huan Tran
(74) *Attorney, Agent, or Firm*—Osha Liang LLP

(57) ABSTRACT

A key operating portion is operated and a scaling size of an image to be printed is selected. Then, the number of the images to be printed is selected. Further, when printing of a plurality of images is set, if a continuous printing determining portion determines that continuous printing is possible based on a limit on an image size relative to a RAM capacity, an image associating portion associates images that are in the number that can continuously be printed. Next, a one-page printing controlling portion exerts control for printing the associated images on one page. Then, a cutting/ejecting controlling portion exerts control on a paper cutting mechanism and a paper transferring mechanism, for cutting an image-printed object of the associated images into the number of the images and ejecting them. As a result, the image-printed object is cut into the number of the images and ejected.

3 Claims, 6 Drawing Sheets

PHOTOPRINTER PRINTING IMAGE ON RECORDING PAPER

BACKGROUND OF THE INVENTION

1. Field of the Invention

The present invention relates to a photoprinter, and particularly, to a photoprinter that prints an image on a heat-sensitive recording paper for developing colors in response to heat and fixing colors in response to light.

2. Description of the Background Art

FIG. 5 is a flowchart showing image-printing steps with a conventional photoprinter. Referring to the flowchart, a process for obtaining three image-printed objects of credit-card size will be described.

First, printing of a first image starts (step S1), and yellow printing is performed. Specifically, the color yellow is developed at a low temperature (step S2). Next, a yellow color-developing layer is fixed with ultraviolet light of 419 nm (step S3). Thereafter, magenta printing is performed. Specifically, the color magenta is developed at an intermediate temperature (step S4). Next, a magenta color-developing layer is fixed with ultraviolet light of 365 nm (step S5). Thereafter, cyan printing is performed. Specifically, the color cyan is developed at a high temperature (step S6). Thus, printing process of the first image ends, and the recording paper is cut and one image-printed object is obtained (step S7).

Next, printing of a second image starts (step S8), and yellow printing is performed. Specifically, the color yellow is developed at a low temperature (step S9). Next, a yellow color-developing layer is fixed with ultraviolet light of 419 nm (step S10). Thereafter, magenta printing is performed. Specifically, the color magenta is developed at an intermediate temperature (step S11). Next, a magenta color-developing layer is fixed with ultraviolet light of 365 nm (step S12). Thereafter, cyan printing is performed. Specifically, the color cyan is developed at a high temperature (step S13). Thus, printing process of the second image ends, and the recording paper is cut and another image-printed object is obtained (step S14).

Next, printing of a third image starts (step S15), and yellow printing is performed. Specifically, the color yellow is developed at a low temperature (step S16). Next, a yellow color-developing layer is fixed with ultraviolet light of 419 nm (step S17). Thereafter, magenta printing is performed. Specifically, the color magenta is developed at an intermediate temperature (step S18). Next, a magenta color-developing layer is fixed with ultraviolet light of 365 nm (step S19). Thereafter, cyan printing is performed. Specifically, the color cyan is developed at a high temperature (step S20). Thus, printing process of the third image ends, and the recording paper is cut and still another image-printed object is obtained (step S21).

With the process as described above, the three image-printed objects are obtained and the continuous printing of three images ends (step S22).

FIG. 6 shows images printed on a recording paper with a conventional photoprinter. In FIG. 6, a recording paper 50 includes a printing region 51 of a first image, a printing region 52 of a second image, a printing region 53 of a third image, a dummy printing region 54 of the first image, a dummy printing region 55 of the second image, and a dummy printing region 56 of the third image. These dummy printing regions 54, 55 and 56 are required by a preprocess for stabilizing the image quality of printing regions 51, 52 and 53, and they are cut off when the printing is finished.

Therefore, after continuously printing three images, three cut-off pieces are left as by-products of the printing.

In FIG. 6, recording paper 50 further includes a printhead raising position 57 for printing the first image, a printing start position 58 of the first image, a printing end position 59 of the first image, a printing start position 60 of the second image, a printing end position 61 of the second image, a printing start position 62 of the third image, and a printing end position 63 of the third image. Printing end position 59 of the first image is also a printhead raising position for printing the second image. Printing end position 61 of the second image is also a printhead raising position for printing the third image. The region between printhead raising position 57 for printing the first image and printing start position 58 of the first image corresponds to dummy printing region 54, while the region between printing end position 59 of the first image and printing start position 60 of the second image corresponds to dummy printing region 55. Similarly, the region between printing end position 61 of the second image and printing start position 62 of the third image corresponds to dummy printing region 56.

For example, when printing a photograph, an operation of preheating the printhead is required when raising the printhead in order to obtain a photograph of better quality. Accordingly, the dummy printing region is provided as a region for the raised printhead to attain a stabilized state. As the dummy printing region becomes unnecessary after the printing is finished, it is cut to be a cut-off piece. Though the printed colors blur to some extent until the raised printhead attains a stabilized state, the blurred portion (the dummy printing region) is cut off and therefore the intended photograph is obtained in an excellent quality.

However, when continuously printing a plurality of image, as a conventional photoprinter requires for each image the steps of developing the color yellow at a low temperature, fixing a yellow color-developing layer with ultraviolet light of 419 nm, developing the color magenta at an intermediate temperature, fixing a magenta color-developing layer with ultraviolet light of 365 nm, developing the color cyan at a high temperature, and cutting the recording paper, there exist a problem that a long printing time is required. Additionally, since cut-off pieces are produced in the number of the image-printed objects, the recording paper is not effectively, but wastefully, used.

It is noted that, while a conventional technique, Japanese Patent Laying-Open No. 2002-67363 describes fast printing,. which is enabled by heating the entire paper at once without repeating heating and cooling processes on a few-dots unit basis so as to avoid delay in printing caused by cooling periods, it is silent about processes for cutting the printing time and for economizing a printing paper when continuously printing a plurality of images. Therefore, it fails to solve the problems described above.

SUMMARY OF THE INVENTION

The present invention is made to solve the problems described above, and an object thereof is to provide a photoprinter that cuts a printing time and that economizes a printing paper when continuously printing a plurality of images.

According to the present invention, a photoprinter is provided that controls color development based on changes in heating temperature using a heat-sensitive recording paper responsive to different temperatures for developing respective three primary colors corresponding to three primary colors of light, fixes colors so as to prevent a color-developing layer responsive to a low temperature from being affected by a high temperature, and prints an image on said recording paper. The photoprinter includes: a printing mechanism printing an image on said recording the; an operating portion for selecting a scaling size of an image to be printed and for setting the number of the image to be printed; and a control processing portion exerting, when continuous printing is possible, control for associating images that are in the number that can continuously be printed and printing the associated images on a region corresponding to one page, and exerting control for cutting an image-printed object of the associated images into the number of the images and ejecting them. Accordingly, the number of steps of a printing process is reduced than that in a conventional manner, whereby the printing time is cut and the printing paper is economized because of the reduced cut-off piece when continuously printing a plurality of images.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, referring to the figures, an embodiment of the present invention will be described. A photoprinter described in the following embodiment controls color development based on changes in heating temperature using a heat-sensitive recording paper responsive to different temperatures for developing respective three primary colors corresponding to three primary colors of light, fixing colors so as to prevent a color-developing layer responsive to a low temperature from being affected by a high temperature, and printing an image on the recording paper. As used herein, fixing means irradiating a recording paper with an ultraviolet light of a specific wavelength so that a color-developing layer of the recording paper loses its heat-sensitive color-developing function. It is essential that the recording paper is a roll of paper.

Figure 1:
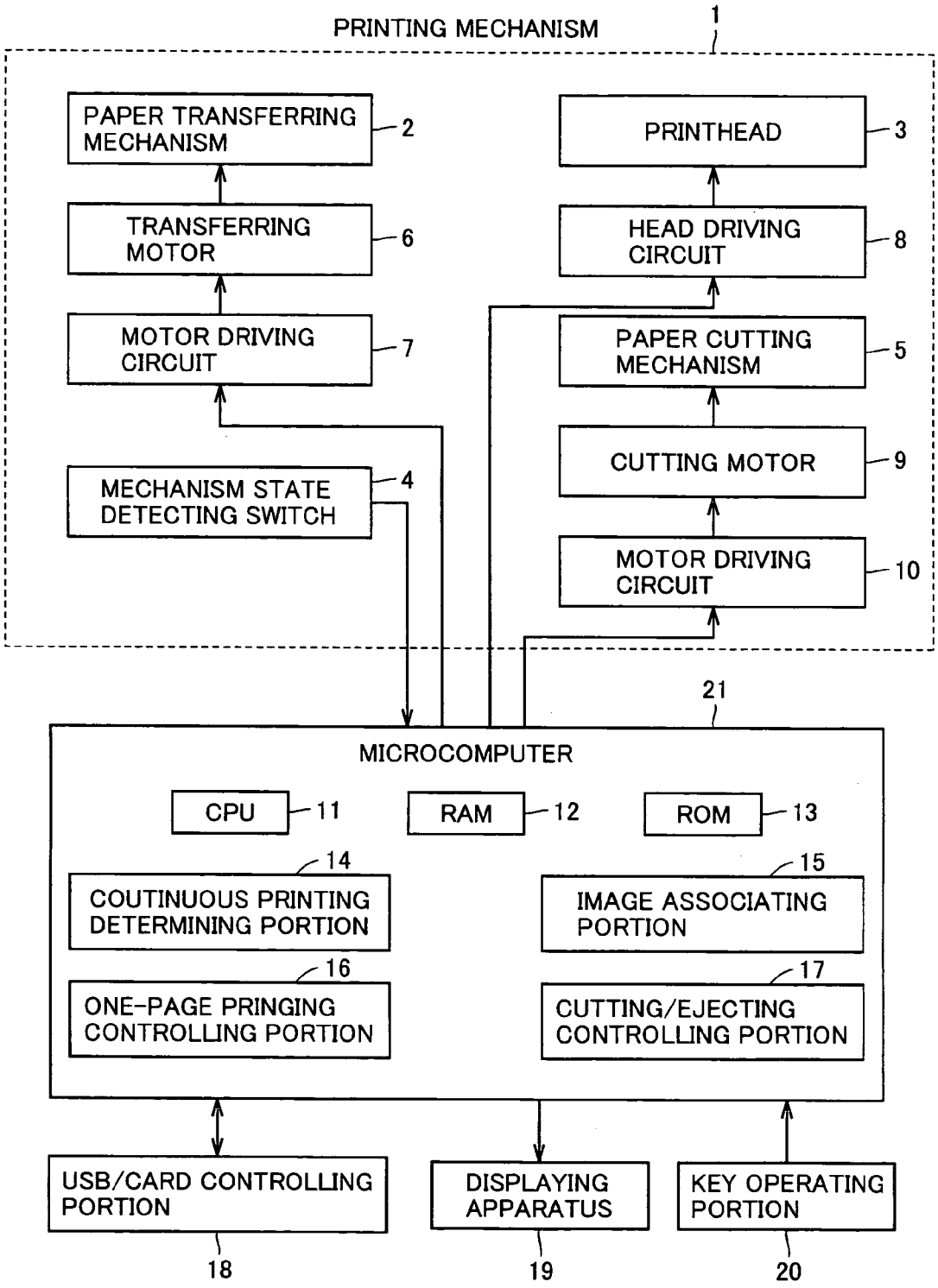
FIG. 1 is a block diagram showing a configuration of a photoprinter according to one embodiment of the present invention.

In FIG. 1, the photoprinter includes a printing mechanism 1 having a paper transferring mechanism 2 as means for transferring a recording paper, a printhead 3 printing an image on the transferred-recording paper, a paper cutting mechanism 5 as paper cutting means for cutting the printed recording paper, and a mechanism state detecting switch 4 as mechanism state detecting means for detecting operating states of them. Mechanism state detecting switch 4 may be a switch detecting the top of a recording paper, a switch detecting the printer running out of a recording paper, or a switch detecting, when cutting a recording paper, whether a cutting blade has run throughout a cutting line of the recording paper and then returned.

Printing mechanism 1 further includes a transferring motor 6 driving paper transferring mechanism 2, a motor driving circuit 7 rotating the transferring motor, a head driving circuit 8 driving printhead 3, a cutting motor 9 driving paper cutting mechanism 5, and a motor driving circuit 10 rotating cutting motor 9.

The photoprinter further includes an USB (universal serial bus)/card controlling portion 18, a key operating portion 20 and a displaying apparatus 19. USB/card controlling portion 18 is for passing data between a microcomputer 21 and a personal computer, which is not shown. For example, USB/card controlling portion 18 may transmit image printing data from a personal computer to microcomputer 21, or it may transmit image printing data from microcomputer 21 to a personal computer. Key operating portion 20 is for selecting a scaling size of an image to be printed, setting the number of images to be printed, and inputting any other operation information. Displaying apparatus 19 is for displaying operation information and the like.

Microcomputer 21 as a control processing portion includes CPU 11 performing arithmetic processing for controlling each of the constituents of the photoprinter, RAM 12 temporarily storing data necessary for the arithmetic processing in CPU 11, ROM 13 storing programs or the like necessary for the operation of CPU 11, a continuous printing determining portion 14 determining whether continuous printing is possible or not based on a limit on an image size relative to the capacity of RAM 12 when printing of a plurality of images is set, an image associating portion 15 associating images that are in the number that can continuously be printed when it is determined that the continuous printing is possible, a one-page-print controlling portion 16 exerting control so that the associated image is printed on one page, and a cutting/ejecting controlling portion 17 for exerting control on paper cutting means 5 and paper transferring mechanism 2, so that the printed object of the associated image is cut into the number of the printed images and ejected.

The limit on an image size relative to the capacity of RAM includes a limit by the image scaling size capacity and a limit by different images. The limit by the image scaling size capacity means that, when continuously printing images using the photoprinter of the present embodiment, the total image size must be in an image size with which the photoprinter of the present embodiment can printout at once. The limit by different images means that, when different images are to be printed in a plurality of numbers, a work area (the capacity of RAM 12 corresponding to an image scaling size) must be allocated for each of the different images, though a conventional photoprinter can address printing several identical images.

Microcomputer 21 may control motor driving circuit 7 in printing mechanism 1 and thereby control driving of transferring motor 6. Additionally, it may control head driving circuit 8 and thereby control printhead 3, or it may control motor drive circuit 10 and thereby control driving of cutting motor head 9.

Figure 2:
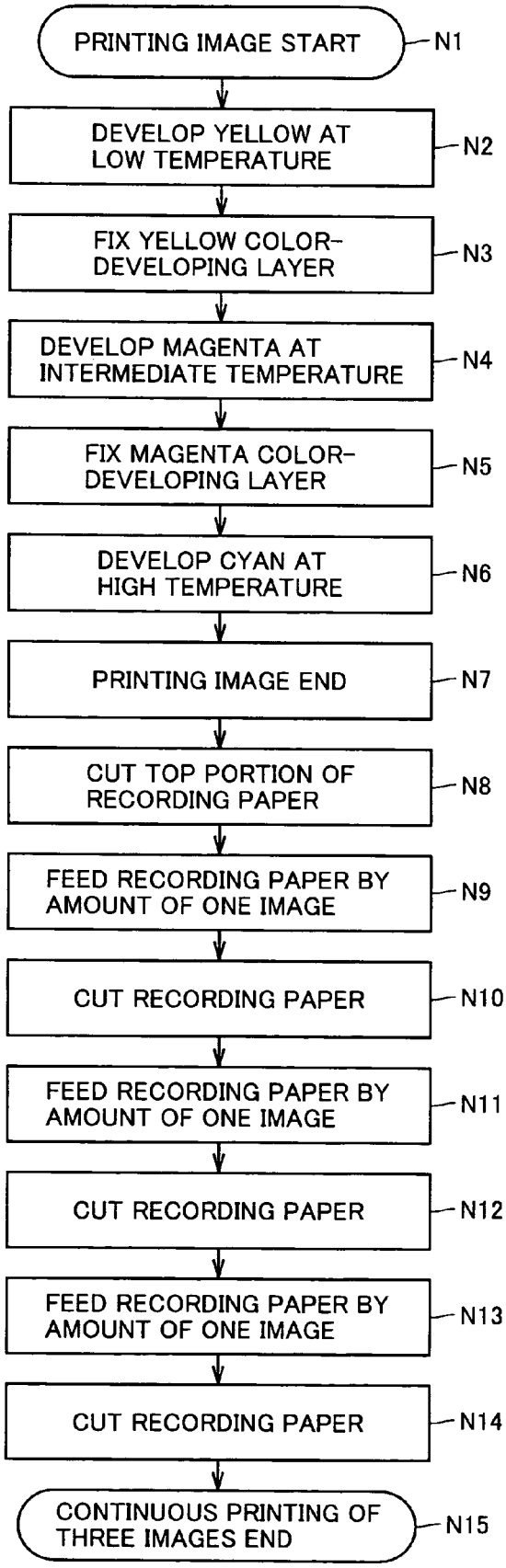
FIG. 2 is a flowchart showing steps of printing images according to the embodiment.

Referring to FIG. 2, a process for continuously printing three images associated with one another to be printed on one page in order to obtain three credit-card sized image-printed objects will be described.

In FIG. 2, printing of associated images starts (step N1), and yellow printing is performed. Specifically, the color yellow is developed at a low temperature (step N2). Next, a yellow color-developing layer is fixed with ultraviolet light of 419 nm (step N3). Thereafter, magenta printing is performed. Specifically, the color magenta is developed at an intermediate temperature (step N4). Next, a magenta color-developing layer is fixed with ultraviolet light of 365 nm (step N5). Thereafter, cyan printing is performed. Specifically, the color cyan is developed at a high temperature (step N6). Thus, printing process of the three associated images on one page ends (step N7), and a top portion of recording paper is cut (step N8).

Next, the recording paper is fed by an amount of one of the associated images (step N9), and the recording paper is cut (step N10). As a result, a first image-printed object is obtained. The recording paper is further fed by an amount of another one of the associated images (step N11), and the recording paper is cut (step N12). As a result, a second image-printed object is obtained. The recording paper is further fed by the last one of the associated images (step N13), and the recording paper is cut (step N14). As a result, a third image-printed object is obtained. With the process as described above, the continuous printing of three images ends (step N15).

With the process as described above, when obtaining three image-printed objects, one cut-off piece is produced, and therefore the printing paper is economized. The cutting operation is performed for n+1 times, where n is the number of image-printed objects. Hence, when obtaining three image-printed objects, the cutting operation is performed for four times, which is fewer than the conventional six times, and therefore the printing time is cut by this difference.

Figure 3:
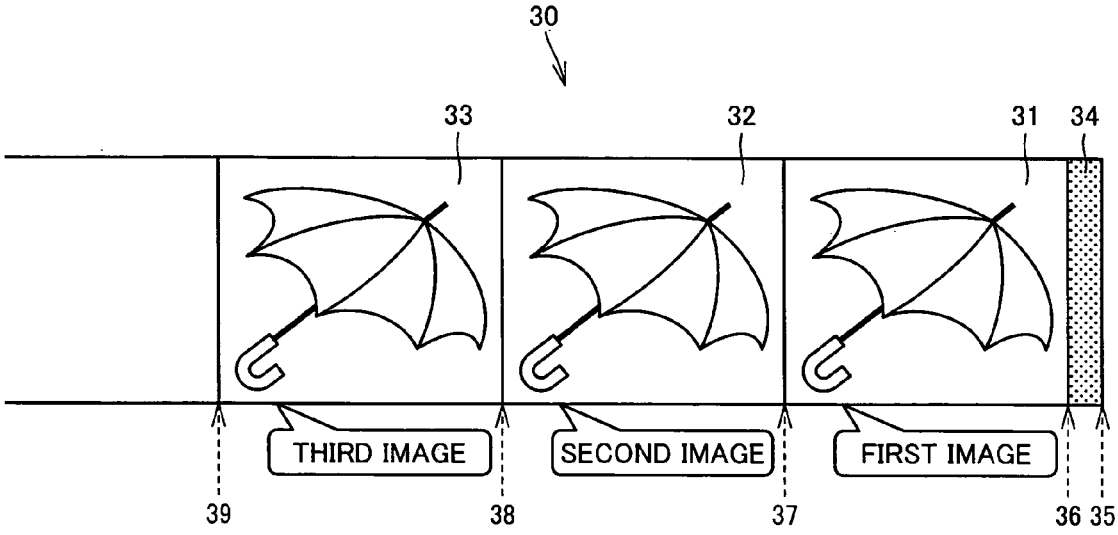
FIG. 3 shows images printed on a recording paper according to the embodiment.

In FIG. 3, a recording paper 30 includes a printing region 31 of a first image, a printing region 32 of a second image, and a printing region 33 of a third image. Images related to these printing regions 31, 32 and 33 are printed on one page. A dummy printing region 34 corresponding to the printing regions for one page is required by a preprocess for stabilizing the image quality of printing regions 31, 32 and 33, and it is cut off when the printing is finished. Therefore, after continuously printing three images, i.e., after continuously printing three images associated with one another on one page, one cut-off piece (the portion corresponding to dummy printing region 34) is left as a by-product of the printing.

In FIG. 3, recording paper 30 further includes a printhead raising position 35 for printing three images associated with one another on one page, a printing start position 36, and a printing end position 39. When printing ends, the paper is cut at positions 36, 37, 38, and 39, and whereby three image-printed object are produced.

According to the present embodiment, printing steps are required only for one page, and the cutting operation is performed for n+1 times, where n is the number of image-printed objects. Hence, it contributes to cut the time required for printing. Though printing three different images requires storage capacity three times as large as that for printing an identical image, it does not pose any problem if the capacity of RAM 12 can address that image size. Additionally, as only one cut-off piece is produced, a recording paper can be economized.

Figure 4:
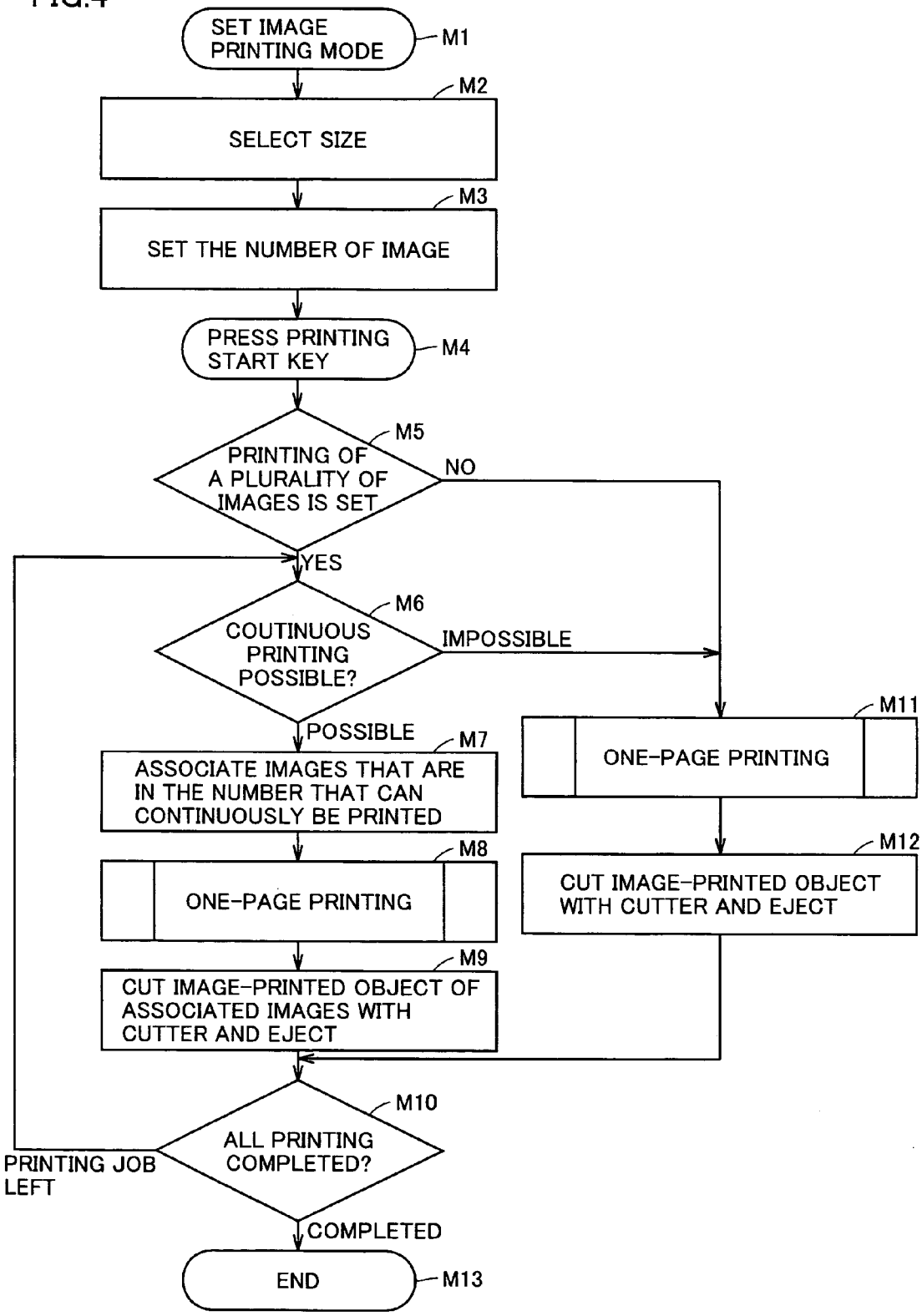
FIG. 4 is a flowchart showing an operation of a microcomputer included in the photoprinter according to the embodiment.
Figure 5:
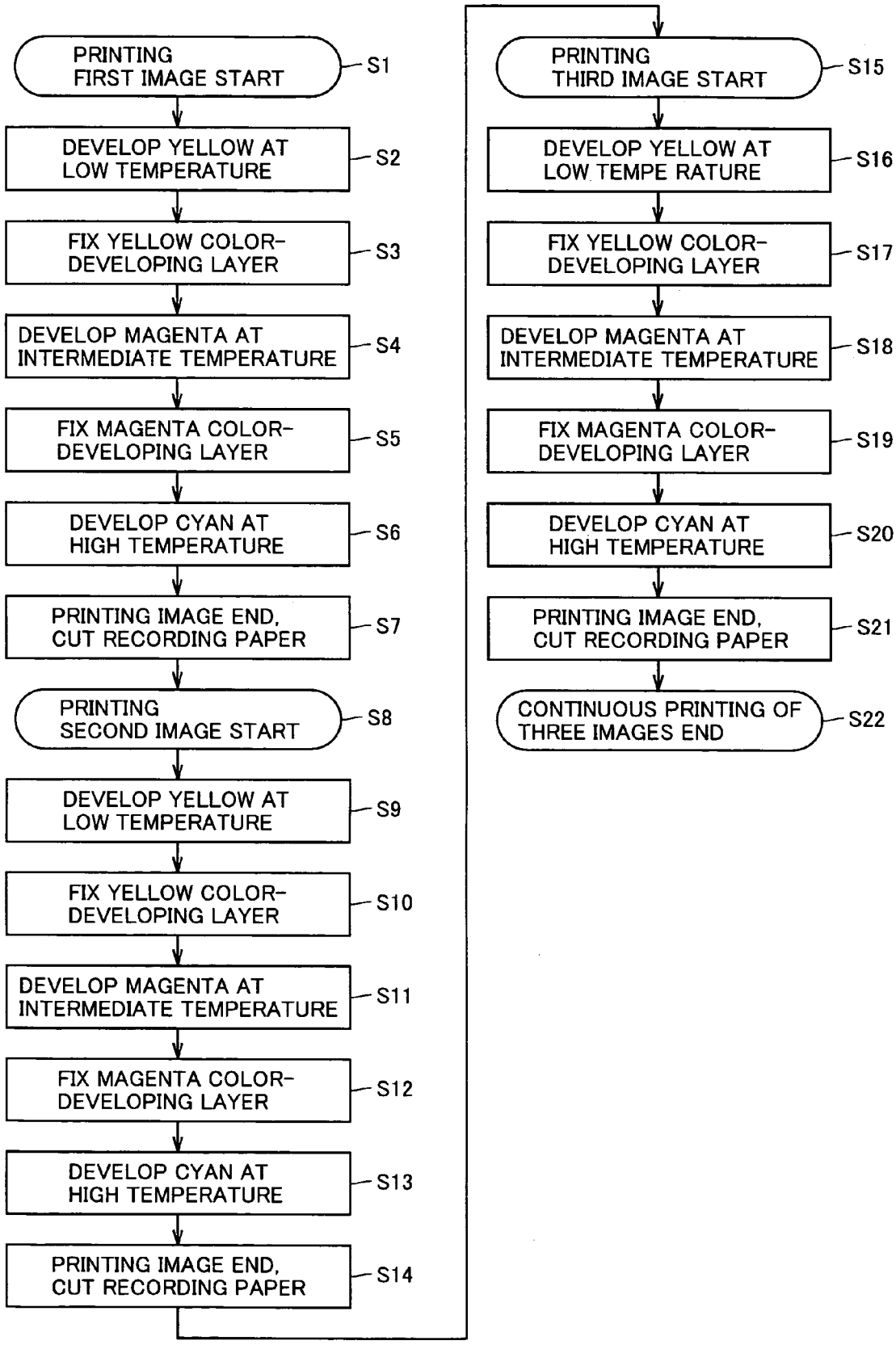
FIG.5 PRIOR ART
FIG. 5 is a flowchart showing image-printing steps with a conventional photoprinter.
Figure 6:
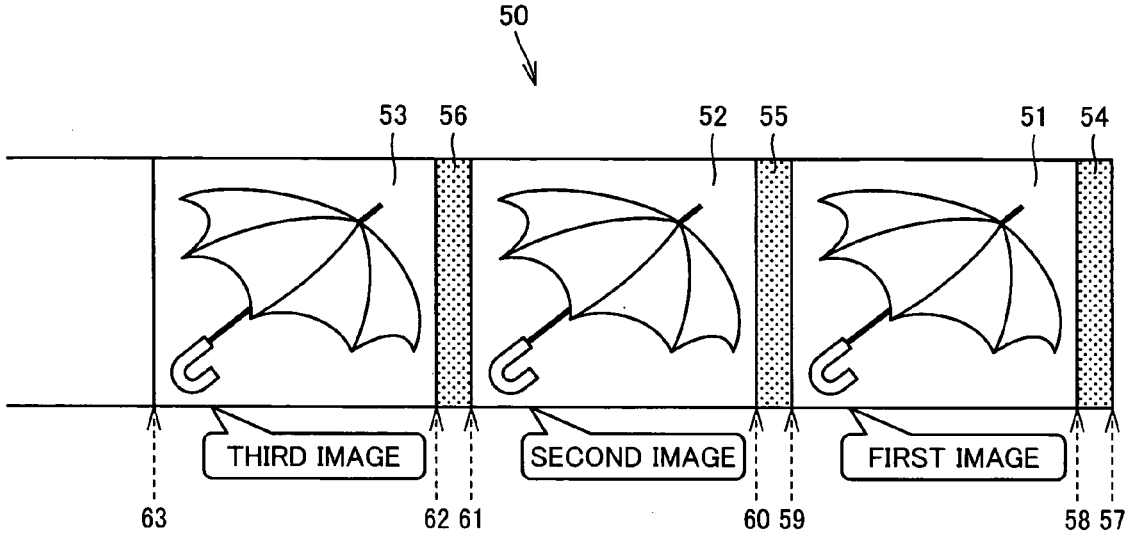
FIG.6 PRIOR ART
FIG. 6 shows images printed on a recording paper with a conventional photoprinter.

Next, following the flowchart of FIG. 4, a continuous printing process, which is the characteristics of the present embodiment, will be described.

The photoprinter of the present embodiment is set to an image printing mode (step M1). Thereafter, a scaling size of an image to be printed is selected (step M2). For example, select a scaling size of an image to be printed, such as panorama size, L size, and credit-card size. This scaling size of an image can be selected by a user's operation. Next, the number of images to be printed is set (step M3), and a printing start key is pressed (step M4).

In response to pressing of the printing start key, microcomputer 21 determines whether printing of a plurality of images is set or not (step M5). Then, if printing of a plurality of images is set, the process goes to step M6, where continuous printing determining portion 14 determines whether continuous printing is possible or not. This determination is performed based on a limit on an image size relative to the capacity of RAM 12, beyond which data of continuous printing cannot be expanded on the storage area of RAM 12.

Less area of RAM 12 is used if continuously printed images are of an identical pattern, since the image data of the identical pattern can repeatedly be used for the required number. On the other hand, if continuously printed images are of different patterns, respectively, more storage area of RAM 12 is required, and hence the limit on continuous printing becomes strict. In other words, the determination as to whether continuous printing is possible or not is performed based on a limit by RAM capacity corresponding to an image scaling size and/or a limit by RAM capacity corresponding to different images.

When it is determined that the continuous printing is possible, image associating portion 15 associates images that are in the number that can continuously be printed (step M7). To this end, the data for printing must be prepared as expanded on the storage area of RAM 12 in advance. If the images that can continuously be printed are of different patterns, respectively, these images are associated with one another. If the images that can continuously be printed are of an identical pattern, an identical image can be used for a plurality of times. Hence, if data for one image is expanded on the storage area of RAM 12 and the data is read for a plurality of times, this operation can be regarded as the association of identical images.

Thereafter, one-page-print controlling portion 16 performs one-page printing where one page contains images that are in the number that can continuously be printed (step M8). For example, for obtaining three image-printed objects, printing of only one page serves the purpose as three images are contained in that single page. After performing one-page printing in this manner, cutting/ejecting controlling portion 17 drives paper cutting mechanism 5 through motor driving circuit 10 and cutting motor 9, thereby cuts the image-printed object resulted from the association of images. It further drives paper transferring mechanism 2 through motor driving circuit 7 and transferring motor 6, thereby ejects the cut image-printed objects (step M9).

Next, it is determined whether all printing was completed or not (step M10). If some printing jobs are left, then the process goes back to step M6. For example, when it is set to continuously print an image A by three pieces, continuously print an image B by three pieces, and continuously print an image C by three pieces, steps M6–M10 are repeated until all printing processes for images A, B and C are completed. When all completed, the process ends (step M13).

On the other hand, when the number of image is set as one at step M3 and it is determined that printing of a plurality of images is not set at step M5, or when it is determined that continuous printing is not possible at step M6, one-page printing is performed where one page contains one image (M11). Thereafter, image-printed object is cut by a cutter and ejected (step M12). Then, the process goes to step M10, and if all printing is completed, the process ends (step M13).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A photoprinter, controlling color development based on changes in heating temperature using a heat-sensitive recording paper responsive to different temperatures for developing respective three primary colors corresponding to three primary colors of light, fixing colors so as to prevent a color-developing layer responsive to a low temperature from being affected by a high temperature, and printing an image on said recording paper, comprising:

a printing mechanism printing an image on said recording paper;

an operating portion for selecting a scaling size of an image to be printed and for setting the number of the image to be printed; and a control processing portion exerting, when continuous printing is possible, control for associating images that are in the number that can continuously be printed and printing the associated images on a region corresponding to one page, and exerting control for cutting an image-printed object of the associated images into the number of the images and ejecting them.

2. The photoprinter according to claim 1, wherein said control processing portion determines whether continuous printing is possible or not based on a limit on an image size relative to a memory capacity.

3. The photoprinter according to claim 1, wherein said printing mechanism includes paper transferring means for transferring said recording paper, a printhead printing an image on said transferred recording paper, paper cutting means for cutting said printed recording paper, and state detecting means for detecting operating state of said paper transferring means, said printhead and said paper cutting means, wherein said control processing portion includes continuous printing determining means for determining whether continuous printing is possible or not based on a limit on an image size relative to a memory capacity when printing of a plurality of images is set, image associating means for associating images that are in the number that can continuously be printed when it is determined that continuous printing is possible, one-page printing controlling means for exerting control for printing the associated images on the region corresponding to one page, and cutting/ejecting controlling means for exerting control on said paper cutting means and said paper transferring means, for cutting an image-printed object of the associated images into the number of the images and ejecting them.

* * * * *